US009082570B2

(12) United States Patent
Kokubu et al.

(10) Patent No.: US 9,082,570 B2
(45) Date of Patent: Jul. 14, 2015

(54) SWITCH DEVICE

(71) Applicant: Niles Co., Ltd., Tokyo (JP)

(72) Inventors: Taito Kokubu, Tokyo (JP); Hideji Onodera, Tokyo (JP)

(73) Assignee: Valeo Japan Co., Ltd., Tokyo (JP)

( * ) Notice: Subject to any disclaimer, the term of this patent is extended or adjusted under 35 U.S.C. 154(b) by 189 days.

(21) Appl. No.: 13/669,013

(22) Filed: Nov. 5, 2012

(65) Prior Publication Data

US 2013/0134029 A1 May 30, 2013

(30) Foreign Application Priority Data

Nov. 24, 2011 (JP) ..... 2011-255745

(51) Int. Cl.

| | |
|---|---|
| ***H01H 23/12*** | (2006.01) |
| ***H01H 23/20*** | (2006.01) |
| ***H01H 21/50*** | (2006.01) |
| ***H01H 23/16*** | (2006.01) |

(52) U.S. Cl.

CPC ..... *H01H 23/205* (2013.01); *H01H 21/50* (2013.01); *H01H 23/162* (2013.01)

(58) Field of Classification Search

CPC .... H01H 23/162; H01H 23/12; H01H 23/205
USPC ..... 200/339, 557, 559, 563, 315, 558
See application file for complete search history.

(56) References Cited

U.S. PATENT DOCUMENTS

| | | | | |
|---|---|---|---|---|
| 5,158,172 | A * | 10/1992 | Roeser et al. | 200/553 |
| 5,607,049 | A * | 3/1997 | Shioda | 200/557 |
| 6,797,905 | B1 * | 9/2004 | Wang et al. | 200/339 |
| 7,071,435 | B2 * | 7/2006 | Altmann | 200/339 |
| 7,115,826 | B2 * | 10/2006 | Sasaki | 200/339 |
| 8,399,783 | B2 * | 3/2013 | Konno et al. | 200/5 R |
| 8,946,576 | B2 * | 2/2015 | Savicki et al. | 200/558 |
| 2013/0112540 | A1 * | 5/2013 | Chen | 200/553 |

FOREIGN PATENT DOCUMENTS

| | | | |
|---|---|---|---|
| DE | 33 16564 | A1 | 12/1984 |
| EP | 1 288 985 | A2 | 3/2003 |
| GB | 872 652 | A | 7/1961 |
| GB | 995 105 | A | 6/1965 |
| GB | 1 227 683 | A | 4/1971 |
| GB | 1 295 198 | A | 11/1972 |
| JP | 2003-077370 | | 3/2003 |

OTHER PUBLICATIONS

United Kingdom Search Report issued Feb. 4, 2013 for corresponding United Kingdom Application No. GB1219462.7.

* cited by examiner

*Primary Examiner* — Edwin A. Leon
*Assistant Examiner* — Ahmed Saeed
(74) *Attorney, Agent, or Firm* — Fishman Stewart Yamaguchi PLLC

(57) ABSTRACT

Electrode sets each composed parallel electrode plates and a slider are arranged in a contact point accommodating chamber formed with wall portions of an upper case and a lower case. A lever of a knob penetrates through a slit hole in a ceiling wall. A tip end of the lever engages blocks in a box portion in the slider. The slider slides while an opening end surface of the box portion makes contact with a lower surface of the ceiling wall surrounding the slit hole. The slider presses a ball urged by a coil spring retained in the box portion press on a swing contact piece supported by a second of the electrode plates to roll thereon, thus switching a conducting state between the second electrode plate, and a first electrode plate and a third electrode plate.

14 Claims, 13 Drawing Sheets

(A)

(B)

SWITCH DEVICE

CROSS-REFERENCE TO RELATED APPLICATION

This application claims priority under 35 USC 119 from Japanese Patent Application No. 255745/2011 filed on Nov. 24, 2011, the disclosure of which is incorporated by reference herein.

BACKGROUND OF THE INVENTION

1. Field of the Invention

The present invention relates to a structure of a switch device.

2. Description of the Related Art

There is conventionally used a device in which an operator lifts up or pushes down one end of a knob to switch contact points, as a switch device suitable for an operation of powered windows in an automobile or the like. This kind of switch devices, as disclosed, for example, in Japanese Patent Laid-Open Publication No. 2003-77370, are designed to perform a switching operation by sliding a slider engaging to a predetermined section of a swing knob. FIG. 12 is a cross section showing the structure of the above-mentioned conventional switch device. Major components in the switch device 100 are incorporated in a plastic case comprising an upper case 105 and a lower case 110.

A knob 102 provided with a lever 103 extending downward is swingably supported by the upper case 105. The upper case 105 is coupled to the lower case 110 at an unillustrated section thereof. Electrode plates 130, 131, and 132 arrayed in a line are arranged on a bottom wall 111 of the lower case 110. Contact points 134 and 135 are respectively provided in the electrode plates 130 and 132 at both the ends. The central electrode plate 131 rises up from the bottom wall 111 to support a swing contact piece 127. The swing contact piece 127 is arrange along the line of the electrode plates 130, 131, and 132, and the electrode plate 131 supports an approximately intermediate position of the swing contact piece 127.

An accommodating wall 113 rises up from the bottom wall 111 to surround the electrode plates 130, 131 and 132, and the swing contact piece 127 to form a contact point accommodating chamber S', and a slider cover 115 provided with a window 116 for insertion of a slider 120 in the central part is mounted to an upward opening portion of the contact point accommodating chamber S'. The slider 120 comprises a head portion 121 engaging to the lever 103 of the knob 102 above the slider cover 115, a tubular portion 122 extending downward through the window 116 of the slider cover 115 from the head portion 121, and a slider plate portion 123 extending in a perpendicular direction to an axis of the tubular portion 112 from the halfway thereof. The tubular portion 122 accommodates a coil spring 124 therein, retains a ball 125 at an opening portion of the tubular portion 122 in a lower end thereof, and presses the ball 125 urged by the coil spring 124 to the swing contact piece 127. The slider 120 is guided by forcing the slider plate portion 123 to move along the lower surface of the slider cover 115, and is provided to be slidable in the front-back direction (right-left direction in the figure).

The swing contact piece 127 is provided with a click portion 128 having a cam shape, and the ball 125 makes contact with the click portion 128. The click portion 128 is provided with the lowest portion of the trough in a position closer to the contact point 134 than a support position by the electrode plate 131. FIG. 12 shows a state where the slider 120 is in a neutral position. In the neutral position, the ball 125 presses the lowest portion of the trough in the click portion 128, so that one end of the swing contact piece 127 is seated on the contact point 134 and the other end is separated from the contact point 135.

When the front end of the knob 102 is pressed, the lever 103 swings in a counterclockwise direction to move the slider 120 from the neutral position to the backward side (right direction in the figure). Thereby without any change in a posture of the swing contact piece 127 supported by the contact point 134 and the electrode plate 131, the ball 125 compresses the coil spring 124, while following the cam shape of the click portion 128. Accordingly, there is no change in an electrical connection state where electricity flows between the contact point 134 and the electrode plate 131. On the other hand, when the front end of the knob 102 is lifted up, the lever 103 swings in a clockwise direction to move the slider 120 from the neutral position to the forward side (left direction in the figure). Accordingly, the ball 125 moves in a direction of the contact point 135 on the click portion 128. As the ball 125 exceeds the support position by the electrode plate 131, since the swing contact piece 127 is made to swing in a counterclockwise direction, one end of the swing contact piece 127 is away from the contact point 134, and the other end is seated on the contact point 135. As a result, the electrical connection state is switched to establish an electrical connection between the electrode plate 131 and the contact point 135.

Incidentally in the switch device, adherence of foreign objects such as dusts to the contact point causes an operational defect. Therefore according to the above-mentioned conventional example, also in a case where the slider 120 moves from the neutral position to the forward side and the backward side respectively, a size of the slider plate portion 123 is set in such a manner as to close the window 116 of the slider cover 115. In this manner, the conventional switch device is designed to prevent the foreign object from entering into the contact point accommodating chamber S' where the electrode plates 130, 131, and 132, and the swing contact piece 127 are positioned.

However, since the slider plate portion 123 is positioned at the lower surface side of the slider cover 115, in a case where foreign objects drop and are accumulated on a section of the slider plate portion 123 exposed to the window 116, the foreign object enters into a gap between the lower surface of the slider cover 115 and the slider plate portion 123 to block a smooth slide of the slider plate portion 123, and further, the foreign object drops off from a peripheral edge of the slider plate portion 123 by repetition of the sliding, creating a possibility that the foreign object enters into the contact point accommodating chamber S'. In addition, only with the aim at guiding the slide of the slider 120 in the first place, although it is only required to form a guide groove in the accommodating wall 113, the slider cover 115 as a component different from the lower case 110 or the upper case 105 is mounted for prevention of the entering of the foreign object. Therefore the conventional switch device has room for further improvement on a point of causing an increase in component costs and mounting man-hours.

For overcoming this problem, for example, as shown in FIG. 13, it is considered to structure a switch device as follows. A slider plate portion 123' of a slider 120' is sized to cover the entirety of the contact point accommodating chamber S', a flange wall 118 extending downward is provided to a peripheral edge of the slider plate portion 123', and the slider 120' covers an accommodating wall 113' to slide thereon, thus abolishing the slider cover 115. However, since the slider 120' slides in the front side and in the back side to the contact point accommodating chamber S', in this case since a predetermined gap K for absorbing a slide amount of the slider 120' is required at each of the front and back sides between the flange wall 118 and an outer surface of the accommodating wall 113', the slider plate portion 123' of the slider 120' is sized to be larger by the amount of the gaps, requiring a large space for its installation. In a case of providing this kind of switch devices to a driver's seat door in an automobile, at least four switch devices are arranged in an arm rest of the door for controlling powered windows in a sedan type of automobiles. However, there is an increasing demand for arranging many switch devices for angular adjustment, and storage/development of door mirrors, door locks, and the like in the arm rest in addition to the above powered window. However, since a space in the arm rest for installation of the switch device is limited, downsizing each of the switch devices is inevitable for meeting the demand for arranging many switch devices in the arm rest. The slider requiring a large space for its installation is not practical in this respect.

SUMMARY OF THE INVENTION

Accordingly, the present invention is made in view of the above-described problems, and an object of the present invention is to provide a switch device which certainly prevents foreign objects such as dusts from entering into contact point portions without its enlargement in size, and reduces the numbers of components in use.

According to an aspect of the present invention, a switch device comprises:

a knob;

an upper case for supporting the knob;

a lower case provided with a fixed contact point;

a movable contact piece connected to/disconnected from the fixed contact point; and a movable member linking to the movable contact piece, the knob being coupled to the movable member to switch connection/disconnection between the fixed contact point and the movable contact piece by an operation of the knob, wherein the upper case and the lower case form a contact point accommodating chamber for surrounding the fixed contact point and the movable contact piece, the movable member is arranged in the contact point accommodating chamber, the knob is provided with a lever for connecting the movable member to the knob, the contact point accommodating chamber has an upper wall provided with a slit hole for passage of the lever, the movable member is provided therein with a recessed portion having a connecting portion to the lever, and the movable member slides while an opening end surface of the recessed portion makes contact with a lower surface of the upper wall surrounding the slit hole.

According to the aspect of the present invention, since the contact point accommodating chamber for accommodating the fixed contact point and the movable contact piece is formed by the upper case and the lower case and does not require the other member for its formation, the numbers of the components in use are eliminated. Since the opening end surface of the recessed portion in the movable member for receiving the lever slides to be hidden by the lower surface of the upper wall in the periphery of the slit hole, it is possible to effectively prevent the foreign object from entering directly through the slide surface into the contact point accommodating chamber where the fixed contact point and the movable contact piece are positioned, without forming the movable member to be large in size.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DESCRIPTION OF THE PREFERRED EMBODIMENTS

Figure 1:
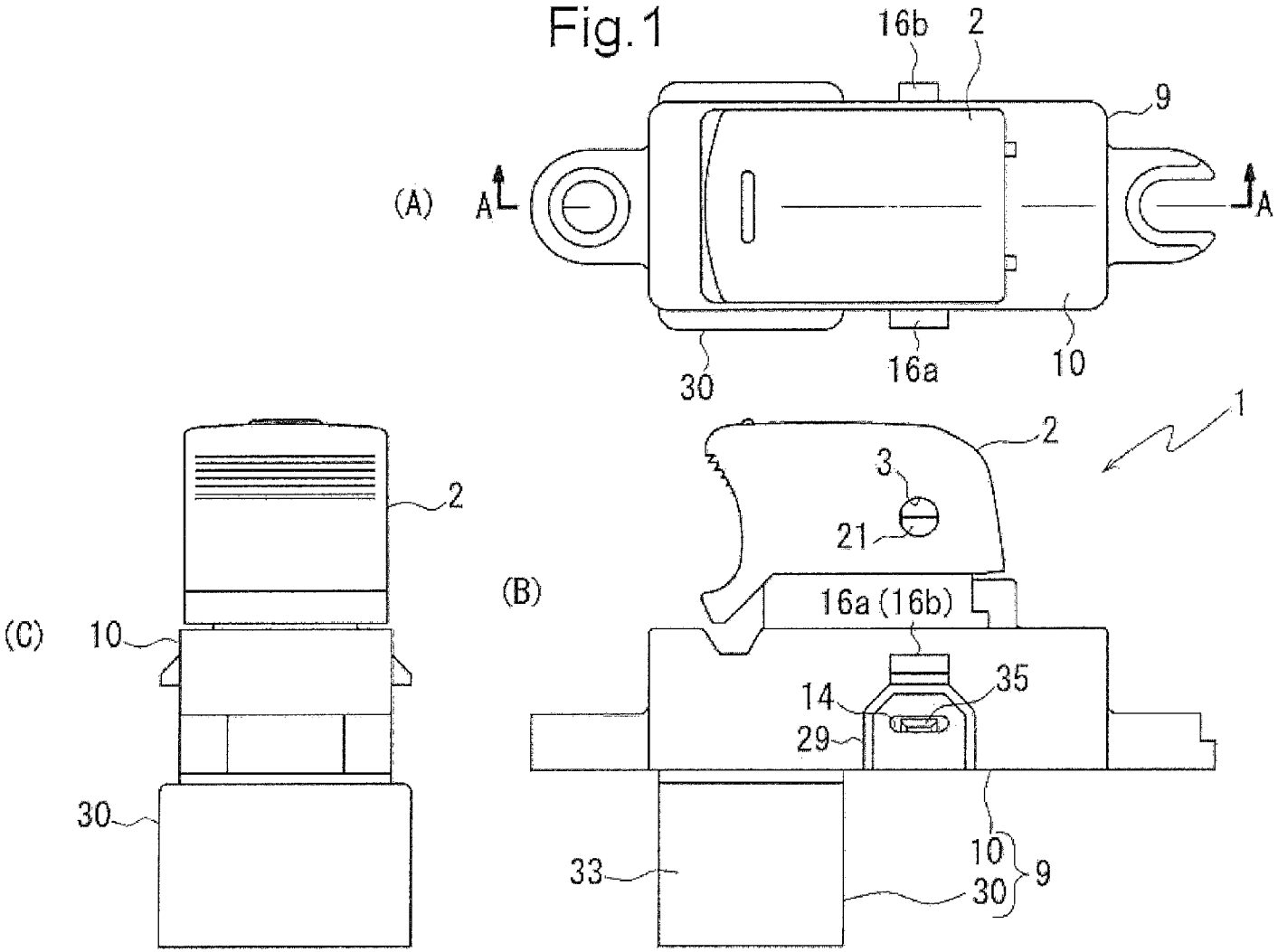
FIG. 1A is a plan view showing an outside appearance of a switch device according to an embodiment in the present invention.
FIG. 1B is a side view showing the outside appearance of the switch device according to the embodiment.
FIG. 1C is a front view showing the outside appearance of the switch device as viewed from a front according to the embodiment.

Next, a switch device according to an embodiment in the present invention will be in detail explained with reference to the accompanying drawings. In FIG. 1A, FIG. 1B and FIG.

1C, a switch device 1 is structured to arrange an electrode set 40, a swing contact piece 46 and a slider 60, which will be described later, within a case 9 comprising a plastic upper case 10 and a plastic lower case 30, and support a knob 2 with the upper case 10. The lower case 30 is provided with a side wall 32 in the peripheral edge of a base 31, and includes a connector portion 33 extending downward from the base 31. Hereinafter, the left side in FIG. 1A and FIG. 1B will be explained as the front side, and the right side in FIG. 1A and FIG. 1B will be explained as the back side along a longitudinal direction of the case 9. The width direction is defined as the right-left direction.

Figure 3:
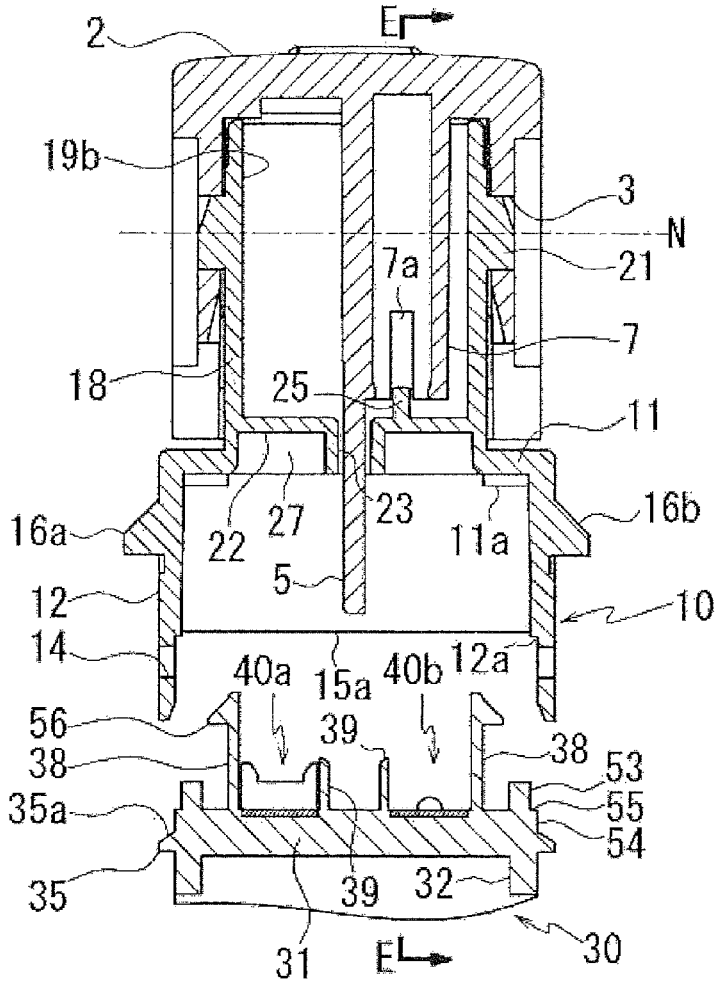
FIG. 3A is a cross section of D-D section in FIG. 2B.
FIG. 3B is a cross section of E-E section in FIG. 3A.
Figure 3:
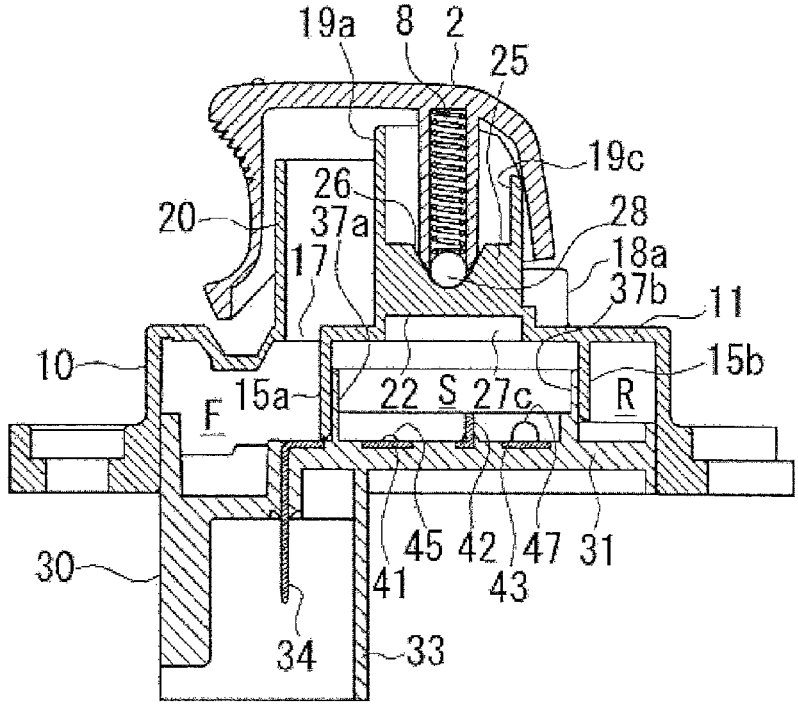

The case 9 is formed in a state of covering the lower case 30 with the upper case 10. Particularly as shown in FIG. 3A, an engagement projection 35 is provided on a lower portion of the outer surface of each of side walls 32 in the lower case 30, and an engagement hole 14 corresponding to the engagement projection 35 is formed on a lower portion in each of the side walls 12 of the upper case 10 overlapping the side walls 32 of the lower case 30. The engagement projection 35 has an inclination surface 35*a* on the upper portion. At the time of pushing down the upper case 10 to the lower case 30, the side wall 12 runs on the inclination surface 35*a*, and when the engagement hole 14 is in a line with the engagement projection 35, a lower edge of the engagement hole 14 is engaged to a lower end surface of the engagement projection 35 to couple the upper case 10 to the lower case 30.

Clicks 16 (16*a* and 16*b*) are formed on the side walls 12 of the upper case 10 for being engaging to fitting portions of the arm rest in the automobile door or the like. The right and left clicks 16*a* and 16*b* are different in size from each other for preventing an erroneous assembly. As shown in FIG. 1B, a tub 29 is formed in a groove shape on the outer surface of the side wall 12 under the click 16 to bypass the engagement hole 14. In a case where water enters from the fitting portion for engagement to the click 16 to adhere to the side wall 12, the tub 29 receives the water drops, which are discharged downward in such a manner as not to enter into the engagement hole 14. Mount brackets 13*a* and 13*b* are respectively provided in both of the front and back ends of the upper case 10, each having a hole or a notch for screw penetration.

Figure 4:
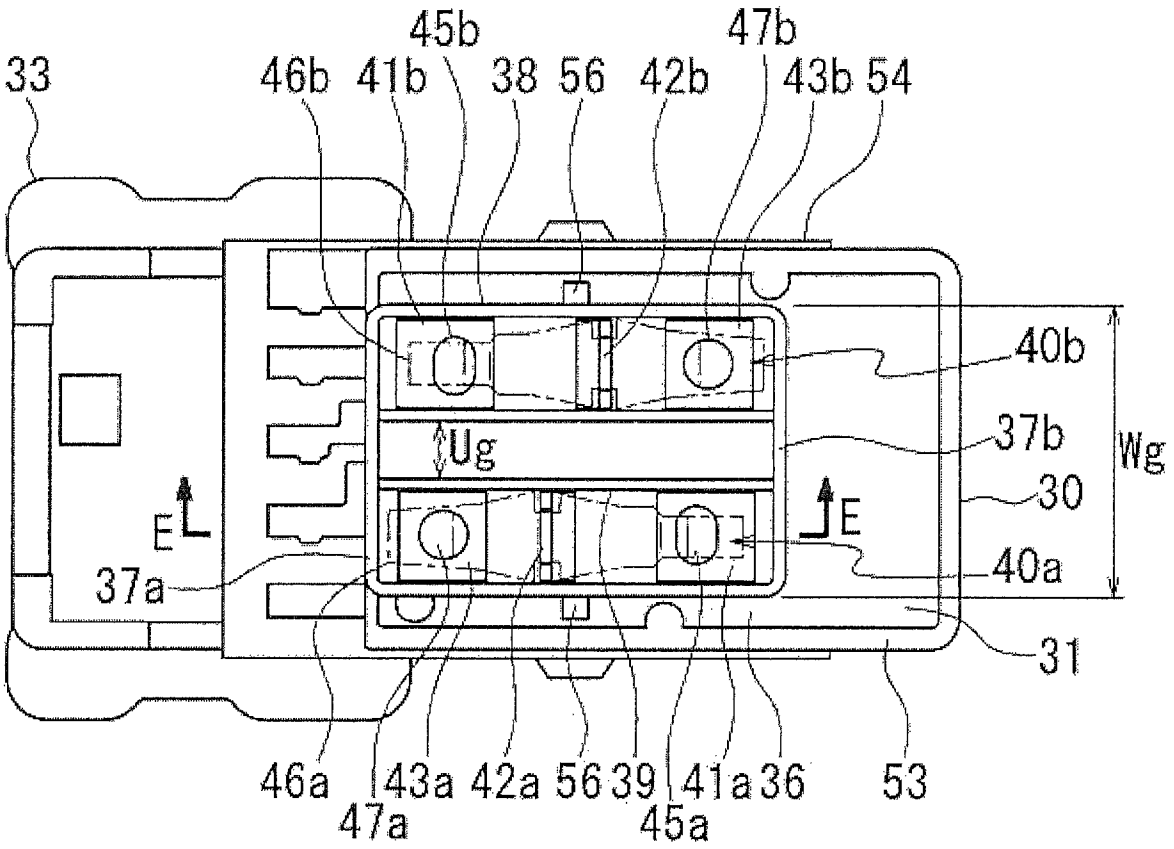
FIG. 4 is a plan view showing the structure of a lower case according to the embodiment.

As shown in FIG. 4, two electrode sets 40 (40*a* and 40*b*) are formed in the base 31 serving as a base plate of the lower case 30 to be in parallel in the right-left direction. The electrode set 40 (40*a* and 40*b*) comprises an electrode plate 41 (41*a* and 41*b*), an electrode plate 42 (42*a* and 42*b*), and an electrode plate 43 (43*a* and 43*b*), which are exposed in a line in the front-back direction. The central electrode plate 42 rises from the base 31 and supports the swing contact piece 46 (46*a* and 46*b*) shown in a virtual line. The swing contact piece 46 is arranged along the line of the electrode plates 41, 42, and 43, and the electrode plate 42 supports a substantially intermediate position of the swing contact piece 46. The electrode plates 41 and 43 at both the ends are flush with the upper surface of the base 31, each of which is provided with a contact point 45 (45*a* and 45*b*) and a contact point 47 (47*a* and 47*b*) as contact portions with the swing contact piece 46 (46*a* and 46*b*).

Figure 5:
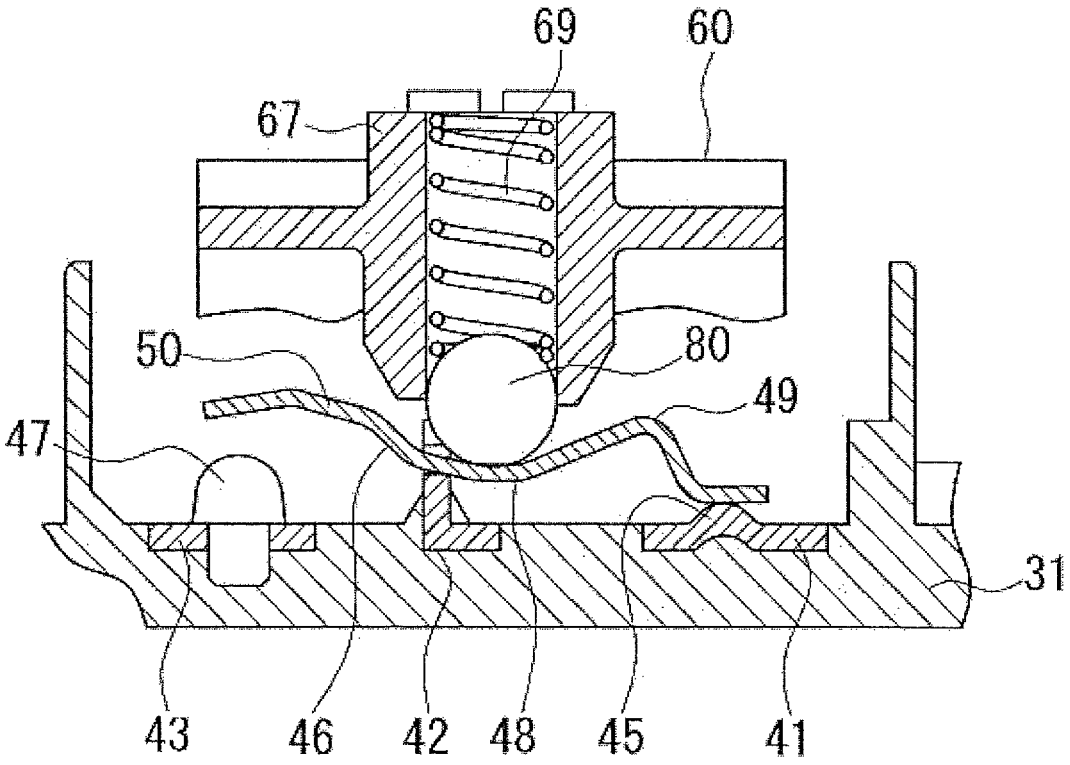
FIG. 5 is a partially enlarged diagram showing a relation between a swing contact piece and contact points according to the embodiment.
Figure 6:
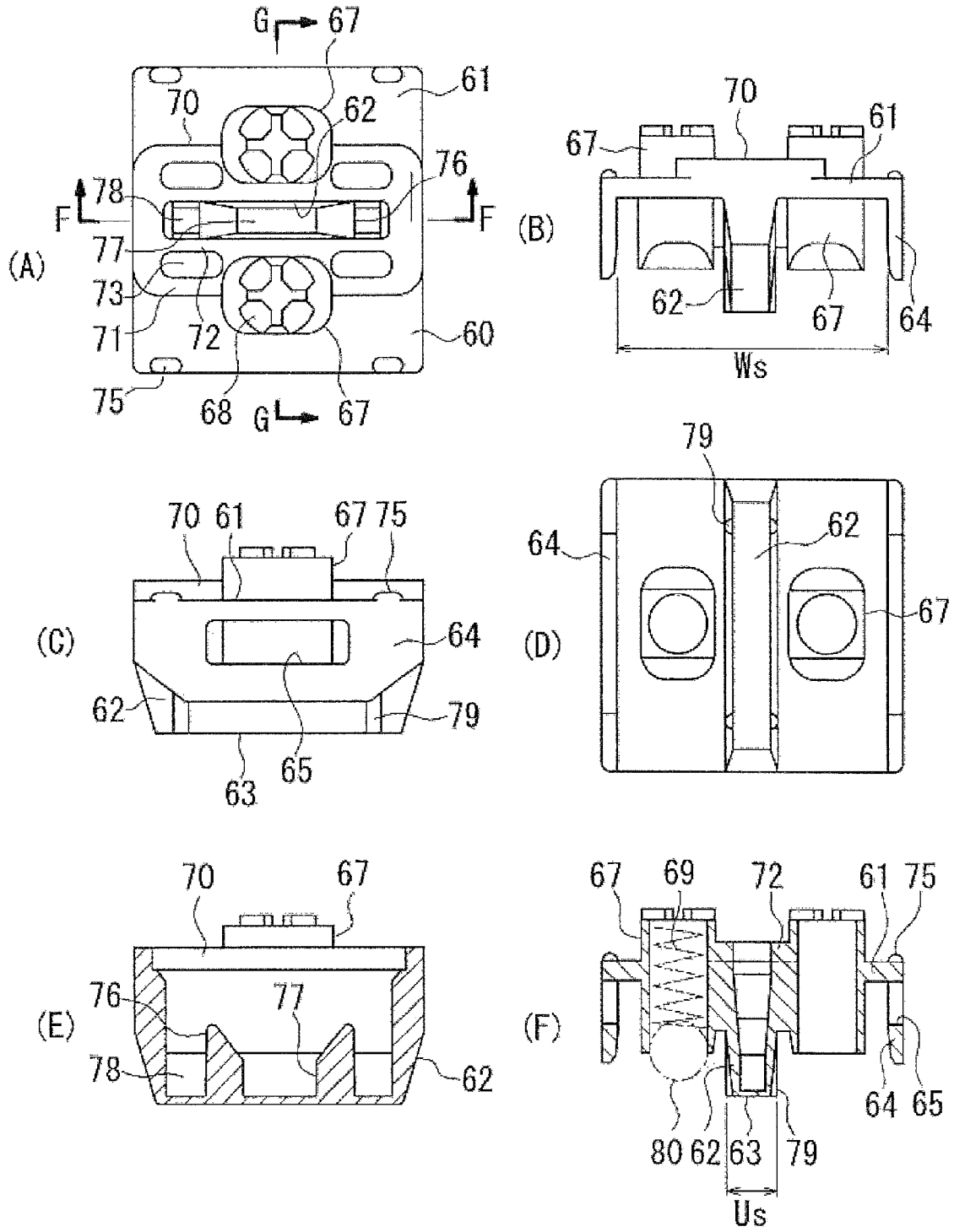
FIG. 6A is a plan view showing a slider according to the embodiment.
FIG. 6B is a front view showing the slider as viewed from a front according to the embodiment.
FIG. 6C is a side view showing the slider according to the embodiment.
FIG. 6D is a back view showing the slider according to the embodiment.
FIG. 6E is a cross section of F-F section in FIG. 6A according to the embodiment.
FIG. 6F is a cross section of G-G section in FIG. 6A according to the embodiment.

FIG. 5 is a partially enlarged view showing a relation between the swing contact piece and the contact point. The swing contact piece 46 has a peak portion 49 between a support position by the electrode plate 42 and a position in a side of the contact point 45, and also has a gradual peak portion 50 in a position in a side of the contact point 47. The position in the side of the contact point 45 forms part of the lowest portion of the trough 48 between both the peak portions than the support position by the electrode plate 42. The line order in the front-back direction of the electrode plates 41, 42, and 43 is in reverse between the electrode sets 40*a* and 40*b*. In a neutral position, a ball 80 urged by a coil spring 69 retained by a slider 60 to be described later presses the lowest portion of the trough 48 in the swing contact piece 46, and thereby one end of the swing contact piece 46 is seated on the contact point 45 and the other end is separated from the contact point 47. This state is in common between the two electrode sets 40*a* and 40*b*. It should be noted that the electrode plates 41, 42, and 43 are molded integrally with the base 31, and respectively extend to a connector portion 33 in the base 31, and the other end forms a terminal 34 (refer to FIG. 3B).

Figure 2:
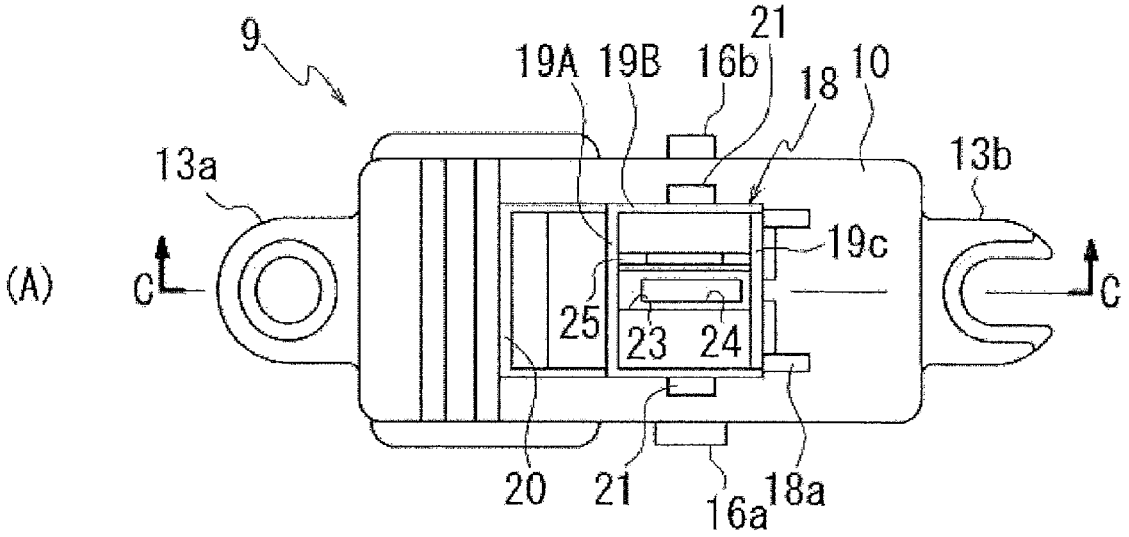
FIG. 2A is a plan view showing the structure of a case according to the embodiment.
FIG. 2B is a cross section of C-C section in FIG. 2A.
Figure 2:
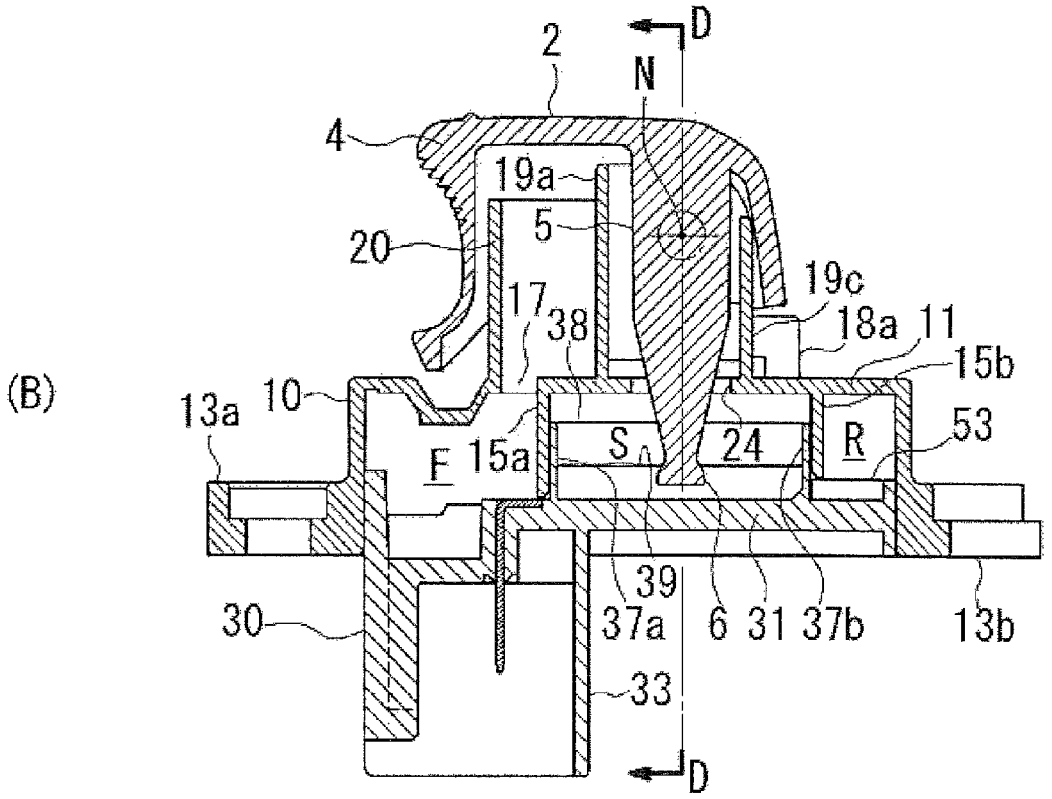

Next, as shown in FIG. 2B and FIG. 3B, a lower accommodating wall 37*a* and a lower accommodating wall 37*b* rise to the vicinity of a ceiling wall 11 of the upper case 10 from the base 31 of the lower case 30 by interposing the electrode set 40 (electrodes 41, 42 and 43) in the front-back direction therebetween. Further, outer guide walls 38 rise to be connected to both of right and left ends of the lower accommodating wall 37*a* and the lower accommodating wall 37*b* to interpose the electrode set 40 in the right-left direction therebetween. Therefore a closed enclosure accommodating the electrode set 40 therein is formed as viewed from above. As shown in FIG. 3A and FIG. 3B, a click 56 is provided on the outer surface of each of the outer guide walls 38. In addition, inner guide walls 39 in parallel to each other are further provided in the central portion of the base 31 in the width direction between the lower accommodating wall 37*a* and the lower accommodating wall 37*b* to extend in the front-back direction. A gap Ug (refer to FIG. 4) between inner surfaces of both the inner guide walls 39 is set in such a manner as to accommodate the lower end portion of a box portion 62 to be described later in the slider 60 for the slider 60 to be capable of sliding therein. A height of the inner guide wall 39 is lower than that of the outer guide wall 38, but the respective electrode sets 40 are arranged to be surrounded by the lower accommodating walls 37*a* and 37*b*, the outer guide walls 38, and the inner guide walls 39 respectively.

Figure 9:
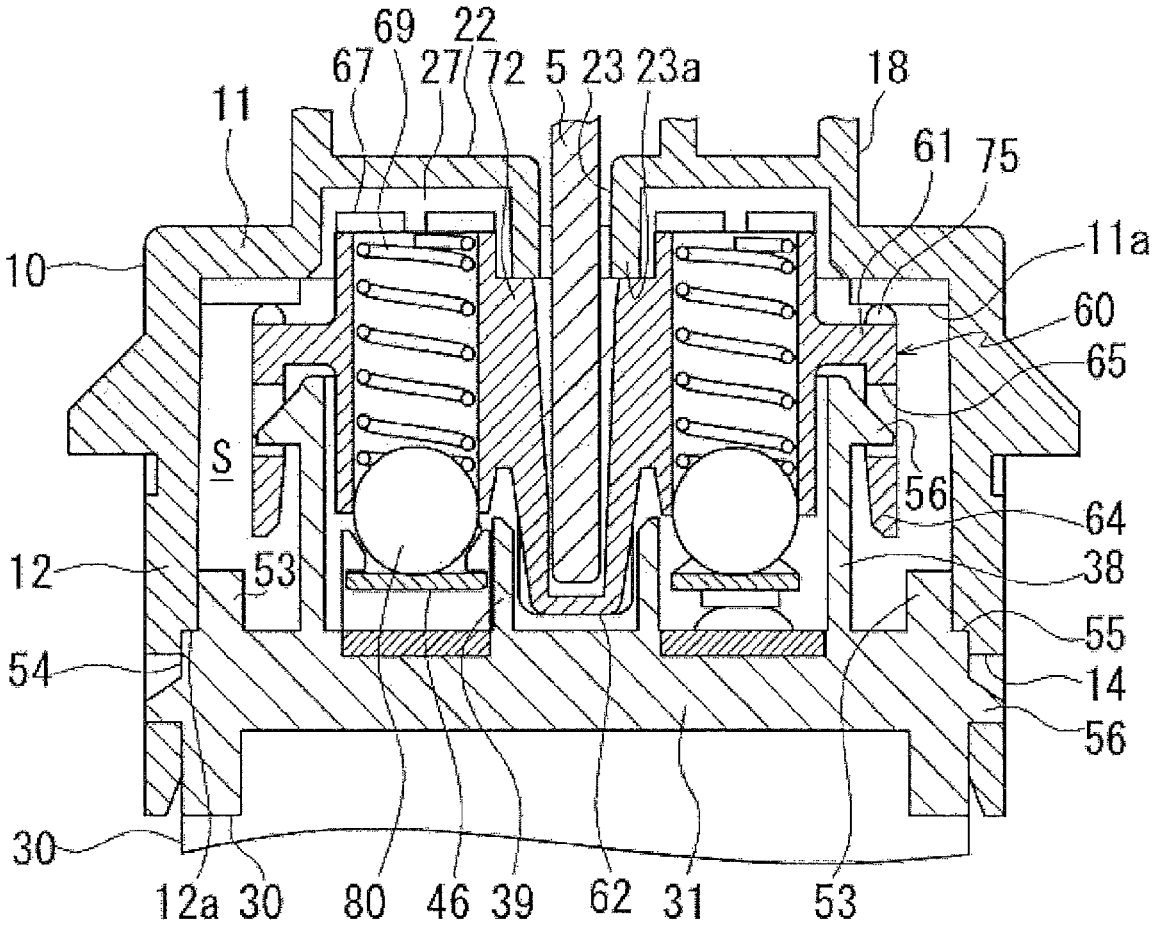
FIG. 9 is a partially enlarged diagram showing the circumference of the contact point accommodating chamber in FIG. 8B according to the embodiment.

As shown in FIG. 3A and FIG. 4, the base 31 of the lower case 30 has extension portions 54 offset outside across the sufficient, front-back direction range including a region between the front and back lower accommodating walls 37*a* and 37*b* forming the enclosure of the electrode set 40. A flange wall 53 is provided to be flush with a general surface of each of the side walls 32 on the upper surface of the base 31 in the back portion of the lower case 30. The flange wall 53 linearly extends to the extension portion 54 outside of the outer guide wall 38 in a plan view (FIG. 4), and thereby part between the outer surface of the extension portion 54 and the flange wall 53 forms a stepped shoulder portion 55 (refer to FIG. 3A and FIG. 9 illustrated later) in a stepped shape. The front end of the flange wall 53 extending to the extension portion 54 is connected to the lower accommodating wall 37*a*, and the front surface of the connection portion is flush with the front surface of the lower accommodating wall 37*a*.

An upper accommodating wall 15*a* connected to both the side walls 12 extends to a point of making contact with the upper surface of the base 31 from the ceiling wall 11 of the upper case 10, and an upper accommodating wall 15*b* extends to a point of making contact with the upper end edge of the flange wall 53. The front upper accommodating wall 15*a* is set to make contact with the front surface of the lower accommodating wall 37*a* and the back upper accommodating wall 15*b* is set to make contact with the back surface of the lower accommodating wall 37*b*. The lower portion of the side wall 12 overlapping the lower case 30 in the upper case 10 spreads for the inner surface to correspond to the extension portion 54 in the lower case 30, and a stepped portion 12*a* is formed in the boundary between the upper portion and the lower portion in the side wall 12.

According to the above structure, a contact point accommodating chamber S defined by the side walls 12, the upper accommodating wall 15*a* and the lower accommodating wall 37*a*, and the upper accommodating wall 15*b* and the lower accommodating wall 37*b* is formed between the ceiling wall 11 of the upper case 10 and the base 31 of the lower case 30 in the case 9. The electrode set 40 and the swing contact piece 46 are arranged in the contact point accommodating chamber S. Contact surfaces between the side wall 12 of the upper case 10 and the side wall 32 of the lower case 30 (and the flange wall 53) is stationary with each other, and, further, the cross section is formed in a crank shape so that the stepped portion 12*a* in a side of the upper case 10 overlaps the shoulder portion 55 in a side of the lower case 30 (refer to FIG. 9). Accordingly, even if the upper case 10 is provided with the engagement hole 14 for connection to the engagement projection 35 of the lower case 30, it is difficult for foreign objects to enter into the contact point accommodating chamber S from the circumference of the side wall 12 in the case 9.

The front upper accommodating wall 15*a* and the front lower accommodating wall 37*a* are in contact with each other across a long distance in the upper-lower direction, and are fixed to each other with no slide relation therebetween. The back upper accommodating wall 15*b* and the back lower accommodating wall 37*b* also are in contact with each other across a long distance in the upper-lower direction, and are fixed to each other with no slide relation therebetween. Accordingly, even if foreign objects enter into a front space F in the case 9, it is extremely difficult for the foreign object to enter further into the contact point accommodating chamber S from there. In addition, since a back space R adjacent to the contact point accommodating chamber S dose not have an opening to outside in the first place, there is no possibility that the foreign object enters into the contact point accommodating chamber S from the back side.

A knob support cylinder 18 having a rectangular cross section and extending upward is provided to be integral with the ceiling wall 11 of the upper case 10 in the contact point accommodating chamber S in a substantially central portion. The knob 2 is mounted to the upper portion of the knob support cylinder 18. That is, as shown in FIG. 3A, shaft bosses 21 are provided on right and left side walls 19*b* of the knob support cylinder 18 to project outside, and shaft holes 3 corresponding to the shaft bosses 21 are provided in the knob 2, so that the knob 2 is to swing around a line connecting the right and left shaft bosses 21 as a swing axis N. The knob 2 is formed in a cap shape to be open downward and to be thin along the contour. The inner surface of the side wall 19*b* is formed as an inclination surface spreading downward from the vicinity of the shaft hole 3, and the axis end of the shaft boss 22 has the upper half portion formed as an inclination surface. When the knob 2 is pressed downward in such a manner as to cover the knob support cylinder 18, the shaft boss 22 flexibly deforms the side wall 19*b* inward to be fitted into the shaft hole 3. The swing axis N is perpendicular to an arrangement direction of the respective electrodes in the electrode set 40.

As shown in FIG. 2B, the knob 2 is provided with a lever 5 extending downward across the swing axis N from the top portion back surface. When a horn portion 4 formed in the front end of the knob 2 is lifted up by fingers, the knob 2 swing s in a clockwise direction around the swing axis N, and when the horn portion 4 is pushed down, the knob 2 swings in a counterclockwise direction. The tip end of the lever 5 is formed as an engagement portion 6 having front and back circular arcs within the swing surface. Stoppers 18*a* extending backward in a rib shape are provided at the lower end portion of the back side wall 19*c*, and make contact with the back lower end edge of the knob 2 to restrict the upper limit of a swing amount of the knob 2 in the clockwise direction.

It should be noted that the upper end configuration of the side wall 19*b* corresponds to the inner surface configuration of the knob 2, and the upper edge of the back side wall 19*c* is lower than the front side wall 19*a*. The side wall 19*b* extends forward more than the front side wall 19*a*, and is bent inside in the width direction in the vicinity of the back surface of the horn portion 4 to form a front longitudinal wall 20. The front longitudinal wall 20 makes contact with the back surface of the horn portion 4 to have a stopper function of restricting the upper limit of the swing amount of the knob 2 in the counterclockwise direction. The lower end of the front longitudinal wall 20 is connected to the ceiling wall 11 as similar to the side wall 19*b*. A hole 17 is formed in the ceiling wall 11 which is a bottom wall of a space between the front longitudinal wall 20 and the side wall 19*a*, and the space between the front longitudinal wall 20 and the side wall 19*a* is communicated with the front space F in the case 9.

The knob support cylinder 18 has a partition wall 22 in a position higher by a predetermined amount than the ceiling wall 11, and forms a portion thereof lower than the partition wall 22 as a part of the contact point accommodating chamber S. As shown in FIG. 2A, FIG. 3A and FIG. 8A, a groove 23 extending in the front-back direction is provided in the center of the partition wall 22 in the width direction to be swollen downward. A bottom wall 23*a* of the groove 23 forms a part of the ceiling wall 11, and therefore the lower surface of the bottom wall 23*a* and the lower surface of the ceiling wall 11 surrounding the knob support cylinder 18 are set to an equal height, that is, to be flush with each other. Therefore as viewed from the contact point accommodating chamber S, the ceiling wall 11 is divided into right and left sides in the width-direction center, which forms two recessed portions 27 extending in the front-back direction therein. In other words, the recessed portion 27 is provided on the ceiling wall 11 for accommodating the upper portion of a tubular portion 67 of the slider 60 to be described later, and the bottomwall 23*a* is called also as the ceiling wall 11 as needed. It should be noted that the recessed portion 27 is swollen slightly backward more than the side wall 19*c* for ensuring a slide stroke of the slider 60 to be described later. The bottom wall 23*a* is provided with a slit hole 24 formed therein to extend in the front-back direction for passage of the lever 5 of the knob 2.

It should be noted that the knob support cylinder 18 extends to a high position in the inside depth of the knob 2 to open therein, and particularly since the side walls 19*b* and 19*c* are in close proximity to the inner wall surface of the knob 2, it is difficult for foreign objects to enter through the gap from outside. In addition, although there exists a space between from the side wall 19*a* to the inner wall surface of the knob 2, since the front longitudinal wall 20 is provided to form a space between the side wall 19*a* and the front longitudinal wall 20 as a pocket, foreign objects are trapped into the pocket, so that it is difficult for the foreign object to enter into the knob support cylinder 18.

As shown in FIG. 3A and FIG. 3B, a click wall 25 extends to a predetermined height from the upper surface of one of the partition walls 22 formed with division by the groove 23 to be in parallel to the groove 23, and the front and back portions of the click wall 25 are connected to the side walls 19*a* and 19*c*. The click wall 25 is provided with a click cam surface 26 in the center in the front-back direction to be formed by the notching of a V-letter shape. A spring retaining cylinder 7 extends downward together with the lever 5 from the back surface of the top wall in the knob 2. A slit 7*a* is formed in a lower end of the spring retained cylinder 7, through which the click wall 25 can pass. In a state where the knob 2 is mounted to the knob support cylinder 18, a coil spring 8 retained in the spring retaining cylinder 7 urges the ball 28 against the click wall 25. In a state where the ball 28 is pressed to the V-letter shaped bottom portion of the click cam surface 26, the knob 2 is in a neutral position (refer to FIG. 3B). When the knob 2 is operated to swing from the neutral position to a clockwise direction or a counterclockwise direction, the ball 28 is displaced upward according to an inclination surface of the click cam surface 26 to compress the coil spring 8, thereby generating a predetermined resistance as an operational force. When the operation of the knob 2 is stopped, the knob 2 is returned to the neutral position by the coil spring 8.

Figure 7:
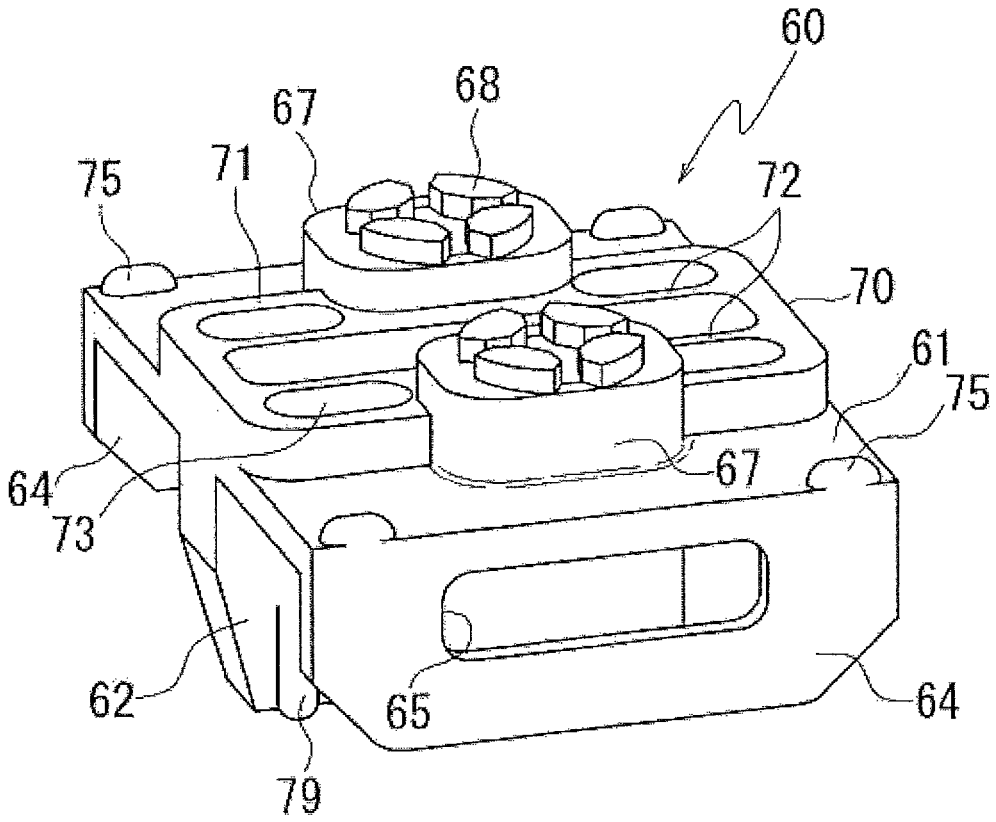
FIG. 7 is a perspective view showing an outside appearance of the slider according to the embodiment.

The slider 60 is retained in the contact point accommodating chamber S. In FIG. 6A to FIG. 6F, and in FIG. 7, the slider 60 comprises a horizontal plate portion 61 having a rectangular plane configuration, a box portion 62 extending downward from the width-direction center of the horizontal plate portion 61 and extending in the front-back direction, and side walls 64 extending downward from both ends of the horizontal plate portion 61 in the width direction. The box portion 62 has a bottom wall 63 at the lower end, and is opened to an upper surface of the horizontal plate portion 61. A long hole 65 extending in the front-back direction is formed in the side wall 64, and the lower edge of the side wall 64 is positioned to the upper side than the lower end surface of the box portion 62. A distance Ws between the inner surfaces of both the side walls 64 corresponds to a width Wg (refer to FIG. 4) between the outer surfaces of the outer guide walls 38 of the lower case 30.

Tubular portions 67 are respectively provided in the center of the slider 60 in the front-back direction to be connected to the box 62 and direct the axis to the upper-lower direction, and an upper portion of the tubular portion 67 projects upward from the horizontal plate portion 61 and a lower end of the tubular portion 67 is in an upper position by a slight amount than the lower edge of the side wall 64. The tubular portion 67 is provided with a coil spring retaining hole formed therein and accommodates the coil spring 69 therein, which urges the ball 80 retaining at the lower end. Front and back corners at the lower end of the tubular portion 67 are chamfered for avoiding interference with the swing contact piece 46.

A frame portion 70 is formed in the center of the width direction on the horizontal plate portion 61. The frame portion 70 is provided across an entire length in the front-back direction of the horizontal plate portion 61, and has a width including a part of each of the tubular portions 67 projecting on the horizontal plate portion 61. The frame portion 70 has an outer frame 71 provided along a peripheral edge thereof and an inner frame 72 extending along an opening edge of the box portion 62. An inner side surface of the inner frame 72 forms part of an extension of an inner wall surface of the box portion 62. Each of regions surrounded by the outer frame 71 and the inner frame 72 (and the tubular portion) has a closed circumference, which is a recessed portion 73 having the horizontal plate portion 61 as a bottom wall. The inner frame 72 is set to surround the slit hole 24 at the lower surface of the bottom wall 23*a* of the groove 23 in the upper case 10, that is, to oppose a side edge portion outside of a hole edge of the slit hole 24.

Projections 75 each having a circular arc in a horizontal section and a predetermined length are provided at both ends in the width direction and at both ends in the front-back direction on the upper surface of the horizontal plate portion 61. The projection 75 makes contact with the ceiling wall 11 in the upper case 10 to reduce a resistance at the time the slider 60 slides in the front-back direction. A contour width of the box portion 62 is tapered toward the lower side, but projections 79 each having a circular cross section are formed on the outer surfaces in the front side and back side and a distance between the outer edges of the right-left projections 79 is set to a constant Us across the upper-lower length. The distance Us between the outer edges corresponds to the gap Ug between the inner surfaces of both the inner guide walls 39 in the lower case 30 (refer to FIG. 4). Engagement blocks 76 are provided in the bottom portion of the box portion 62 in the front-back direction center thereof. The engagement blocks 76 are provided with a slot 77 corresponding to the engagement portion 6 at the tip end of the lever 5, and a corner of the upper end opening of the slot 77 is chamfered for easy insertion of the engagement portion 6 on assembling. Gaps are left in the front and back sides of the engagement blocks 76 in the box portion 62 to form pockets 78.

In FIG. 8A and FIG. 8B, the slider 60 is arranged in the contact point accommodating chamber S such that a lower end opening of the tubular portion 67 is positioned in the vicinity of the swing contact piece 46, and the swing contact piece 46 is pressed by the ball 80 urged by the coil spring 69.

It should be noted that for assembling the slider 60, the coil spring 69 and the ball 80, the coil spring retaining hole of the tubular portion 67 is first formed as a through hole having a constant diameter. Then when the slider 60 is pushed down in a state where the lower end opening of the tubular portion 67 is in a line with the swing contact piece 46 supported to each of the electrode plates 42, the long holes 65 of the side walls 64 are engaged to the clicks 56 of the outer guide walls 38 (refer to FIG. 9 to be illustrated later). In this state, the ball 80 and the coil spring 69 are sequentially inserted from the upper end opening of the tubular portion 67, and next, a caulking tool is used to caulk the upper end (through hole opening end) of the tubular portion 67 in a state where the upper end of the coil spring 69 is pushed and inserted into the through hole for prevention of the dropout. In FIG. 6A to FIG. 6F, and in FIG. 7, at 68 are denoted caulked portions after being caulked. Therefore the slider 60 presses the ball 80 on the swing contact piece 46 with the compressed coil spring 69.

Figure 8:
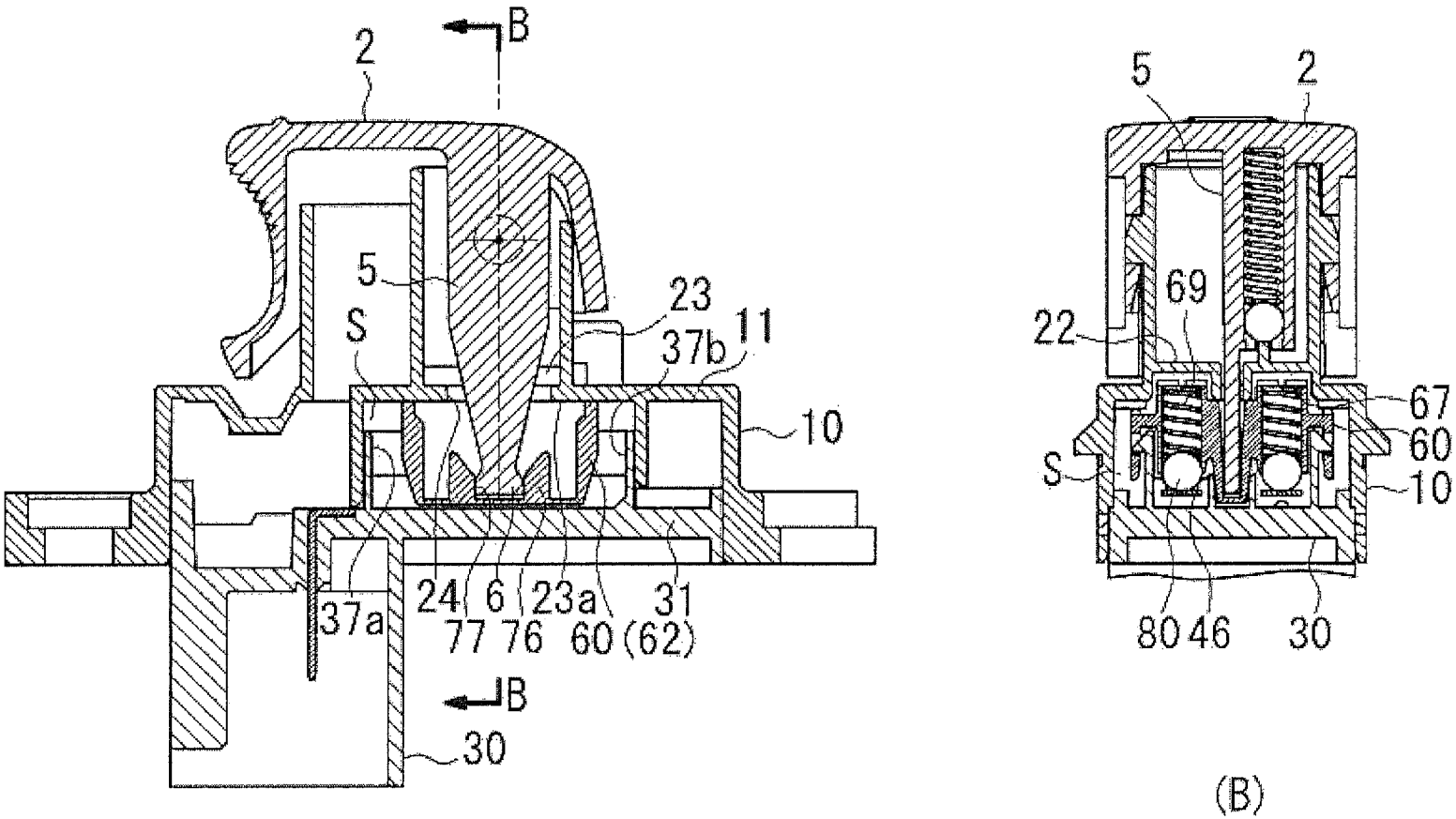
FIG. 8A is a cross section of A-A section in FIG. 1A and shows a state where the slider and the knob are assembled to the case according to the embodiment.
FIG. 8B is a cross section of B-B section in FIG. 8A.

In addition, in FIG. 8, the lever 5 of the knob 2 penetrates through the groove 23 of the partition wall 22 and the slit hole 24 of the bottom wall 23*a* (ceiling wall 11), and makes the engagement portion 6 in the tip end be engaged to the slot 77 in the engagement blocks 76 to be connected to the slider 60. when the knob 2 and the slider 60 are in a neutral position, as shown in FIG. 5 previously, the ball 80 presses the lowest portion of the trough 40 in the swing contact piece 46, and thereby one end of the swing contact piece 46 is seated on the contact point 45, and the other end is separated from the contact point 47.

In FIG. 9, the slider 60 is urged upward by a reaction of the coil springs 69, and the projections 75 of the horizontal plate portion 61 are pressed on the lower surface of the ceiling wall 11 in the upper case 10. In this state, a height of the partition wall 22 of the knob support cylinder 18 is set not to interfere with the upper portion of the tubular 67. That is, the recessed portion 27 formed in the partition wall 22 accommodates the tubular portion 67 projecting from the horizontal plate portion 61 in the slider 60. In addition, a height of the frame portion 70 in the slider 60 is set such that the upper surface of the inner frame 72 makes contact with the lower surface of the bottom wall 23*a* (ceiling wall 11) of the groove 23 in the partition wall 22 in a state where the projection 75 is in contact with the lower surface of the ceiling wall 11 in the upper case 10. It should be noted that since the height of the frame portion 70 is different from that of the projection 75, offsets 11*a* opposing the projections 75 are provided on the lower surface of the ceiling wall 11 for absorbing the difference in height between the frame portion 70 and the projection 75. Since the slider 60 forms the projections 75 provided at both the ends of the horizontal plate portion 61 in the width direction as contact portions to the lower surface (offset portion 11*a*) of the ceiling wall 11, the posture of the slider 60 is stably retained. Therefore a tight contact state between the upper surface of the inner frame 72 and the lower surface of the bottom wall 23*a* of the groove 23 is ensured to generate no gap by the inclination of the slider 60.

Figure 10:
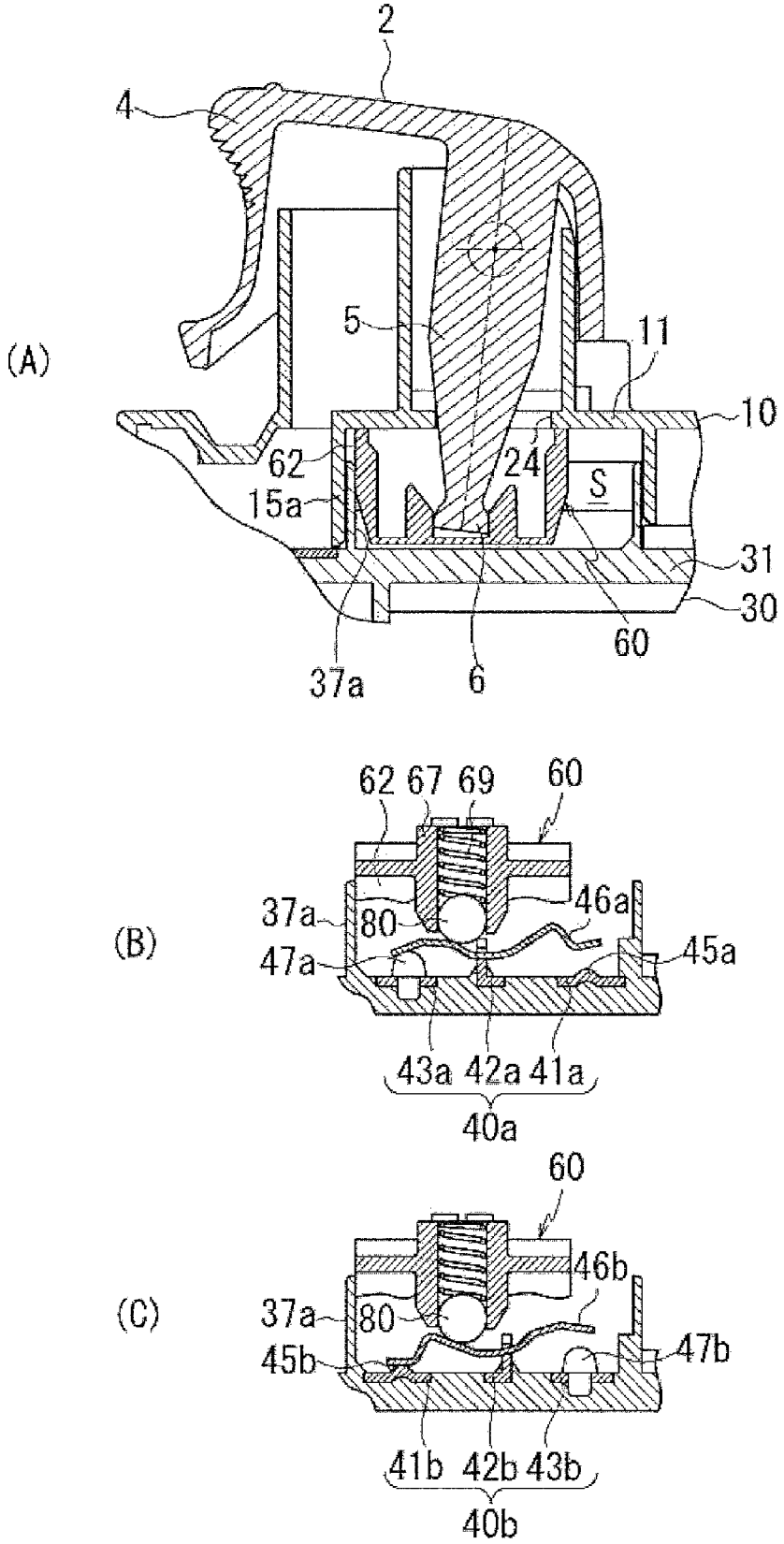
FIG. 10A, FIG. 10B and FIG. 10C are diagrams showing an operation of the switch device according to the embodiment.

An operation of the switch device 1 structured as above will be explained hereinafter. As shown in FIG. 10A, when the side of the horn portion 4 of the knob 2 is lifted up, the lever 5 swings in a clockwise direction for the engagement portion 6 to push the slider 60 forward (left side). In the one electrode set 40*a*, as shown in FIG. 10B, the ball 80 retained by the one tubular portion 67 of the slider 60 having forward moved compresses the coil spring 69, while rolling on the swing contact piece 46*a*, and exceeds the support position by the electrode plate 42*a*. As a result, the swing contact piece 46*a* swings in a counterclockwise direction, one end thereof is separated from the contact point 45*a* and the other end is seated on the contact point 47*a*. Thereby the electrical connection state is switched, so that the electrode plate 42*a* and the contact point 47*a* becomes in a conducting state. During the period, as shown in FIG. 10C, in the other electrode set 40*b*, the ball 80 rolls only on the swing contact piece 46*b* between the contact point 45*b* and the electrode plate 42*b* and does not exceed the support position by the electrode plate 42*b*. Therefore, the posture of the swing contact piece 46*b* does not change, and the conducting state between the electrode plate 42*a* and the contact point 45*a* is maintained with no change of the electrical connection state as similar to the neutral position.

Figure 11:
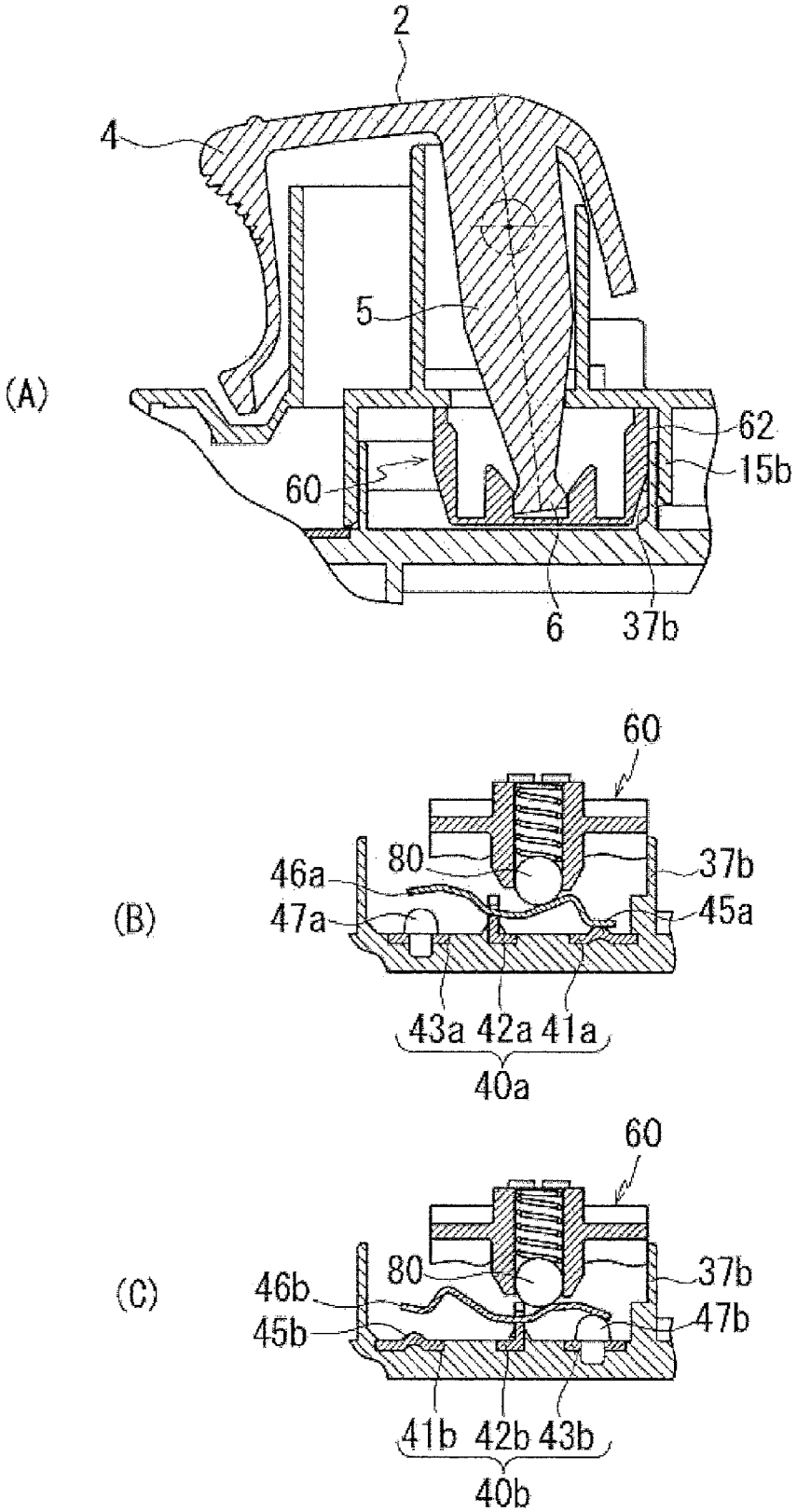
FIG. 11A, FIG. 11B and FIG. 11C are diagrams showing an operation of the switch device according to the embodiment.
Figure 12:
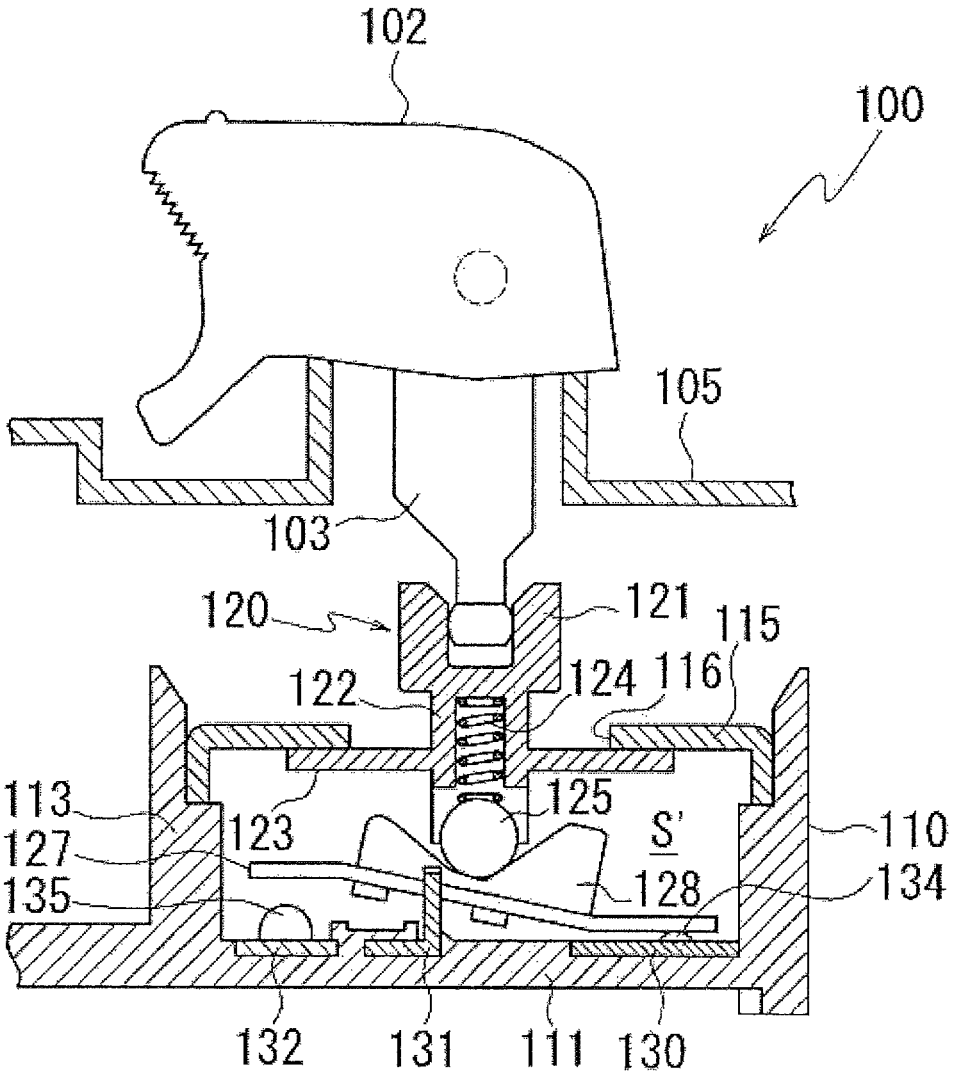
Fig. 12 PRIOR ART
FIG. 12 is a diagram showing the conventional example.
Figure 13:
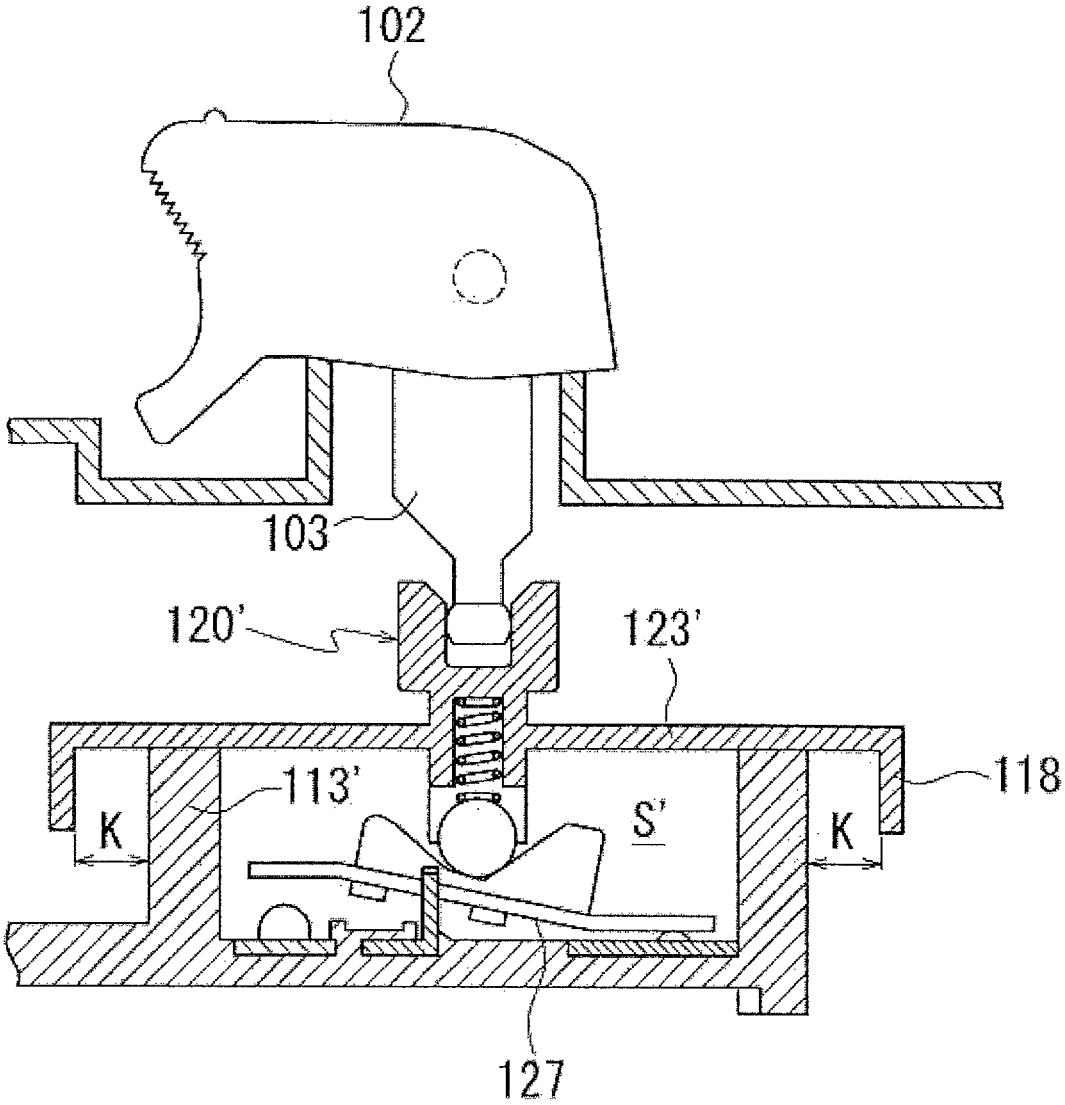
Fig.13 PRIOR ART
FIG. 13 is a diagram showing a comparison countermeasure example to the conventional example.

In reverse, when the side of the horn portion 4 of the knob 2 is pushed down, as shown in FIG. 11A, the lever 5 rotates in a counterclockwise direction for the engagement portion 6 to push the slider 60 backward (right side). Therefore, as shown in FIG. 11B, in the one electrode set 40*a*, the ball 80 does not exceed the support position of the swing contact piece 46*a* by the electrode plate 42*a*, the posture of the swing contact piece 46*b* does not change, and as similar to the neutral position, the conducting state between the electrode plate 42*a* and the contact point 45*a* is maintained with no change of the electrical connection state. On the other hand, in the other electrode set 40*b*, as shown in FIG. 11C, the ball 80 compresses the coil spring 69, while rolling on the swing contact piece 46*b*, and exceeds the support position by the electrode plate 42*b*. As a result, the swing contact piece 46*b* swings in a clockwise direction, and one end thereof is separated from the contact point 45*b* and the other end is seated on the contact point 47*b*. Thereby the electrical connection state is switched, so that the electrode plate 42*b* and the contact point 47*b* becomes in a conducting state.

As described above, in the switch device 1, by sliding the slider 60 by the knob 2 swinging in the clockwise direction and in the counterclockwise direction, the electrical connection state in the two sets of the electrode sets 40*a* and 40*b* can be switched. At this time, the slider 60 is structured such that the horizontal plate portion 61 is provided along the ceiling wall 11 in the upper case 10 and the side wall 64 slides along the outer guide wall 38 in the lower case 30. In addition, the horizontal plate portion 61 forms the projections 75 at both the ends in the width direction as the contact portions to the lower surface of the ceiling wall 11 (offset portion 11*a*), and the projections 79 in which a distance between the right-left outer edges of the box portion 62 is constant across the upper-lower range are formed as contact portions to the inner guide walls 39, thus reducing the respective slide resistances to be small.

Here, the frame portion 70 in the slider 60, particularly the upper surface of the inner frame 72 as the substantial opening end surface of the box portion 62 makes contact with the lower surface of the ceiling wall 11 (bottom wall 23*a* of the groove 23) from downward, and the slit hole 24 of the ceiling wall 11 is opened to the inside of the inner frame 72. Therefore even if foreign objects drop down from the slit hole 24 into the box portion 62 in the slider 60, the foreign objects are not nearly accumulated between contact surfaces of the lower surface of the ceiling wall 11 and the upper surface of the frame portion 70. Therefore even if the slider 60 moves by an operation of the knob 2 so that the lower surface of the ceiling wall 11 and the frame portion 70 slide with each other, there is no possibility that foreign objects pass through therebetween to enter into the contact point accommodating chamber S.

Further, just in case where foreign objects spill to the side of the contact point accommodating chamber S from between the ceiling wall 11 and the inner frame 72, since the foreign objects are trapped in the recessed portion 73 between the inner frame 72 and the outer frame 71, the foreign objects never reach the contact points 45 and 47, and the like. In addition, since the pockets 78 are formed at both the sides of the engagement blocks 76 in the box portion 62, the movement of the foreign object having entered into the pockets 78 to the slot of the engagement blocks 76 is restricted to maintain a smooth connection state between the engagement portion 6 of the lever 5 and the engagement block 76.

In the present embodiment, the electrode plates 41, 42 and 43 correspond to fixed contact pieces in the present invention. Particularly the electrode plate 41 corresponds to a first electrode, the electrode plate 42 corresponds to a second electrode, and the electrode plate 43 corresponds to a third electrode. The swing contact piece 46 corresponds to a movable contact piece. The slider 60 corresponds to a movable member. The box portion 62 corresponds to a recessed portion. The engagement block 76 corresponds to a connection portion. The recessed portion 73 corresponds to a first trapping recessed portion. The pocket 78 corresponds to a second trapping recessed portion. The ball 80 which is urged by the coil spring 69 retained by the tubular portion 67 and rolls on the swing contact piece 46 forms part of a pressing unit. The coil spring 69 corresponds to a spring. The ceiling wall 11 corresponds to an upper wall of a contact point accommodating chamber. The side wall 12 and the upper accommodating walls 15*a* and 15*b* form wall portions extending in the upper-lower direction from an upper case. The side wall 32 and the lower accommodating walls 37*a* and 37*b* form wall portions extending in the upper-lower direction from a lower case.

The present embodiment is structured as above, and a switch device comprises the knob 2, the upper case 10 for supporting the knob 2, the lower case 30 provided with the electrode plates 41, 42 and 43, the swing contact piece 46 connected to/disconnected from the electrode plates 41 and 43, and the slider 60 linking to the swing contact piece 46, wherein the knob 2 is coupled to the slider 60, and connection/disconnection between the electrode plates 41 and 43 and the swing contact piece 46 is switched by an operation of the knob 2, wherein the upper case 10 and the lower case 30 form the contact point accommodating chamber S for surrounding the electrode plates 41, 42 and 43 and the swing contact piece 46, the slider 60 is arranged in the contact point accommodating chamber S, the knob 2 is provided with the lever 5 for coupling the slider 60 to the knob 2, the contact point accommodating chamber S has the upper wall 11 provided with the slit hole 24 for passage of the lever 5, the slider 60 is provided therein with the box portion 62 having the engagement blocks 76 connecting to the lever 5, and the slider 60 slides while the opening end surface of the box portion 62 makes contact with the lower surface of the upper wall 11 surrounding the slit hole 24.

Therefore, the contact portions between the swing contact piece 46, and the electrode plate 41 and the like are arranged in the contact point accommodating chamber S formed by the upper case 10 and the lower case 30 fixed with each other to be blocked from the circumference, thus preventing a contact defect due to the entering of the foreign object. In addition, since the formation of the contact point accommodating chamber S does not require the other member, the numbers of the components in use are also eliminated. The slit hole 24 for the passage of the lever 5 is provided in the ceiling wall 11 of the contact point accommodating chamber S, and is communicated only with the inside of the box portion 62 in the slider 60. Since the slide surface of the slider 60 (the opening end surface of the box portion 62) is hidden by the lower surface of the ceiling wall 11, even if foreign objects pass through the slit hole 24, the foreign object is accumulated only on the bottom portion of the box portion 62, and it is possible to effectively prevent the foreign object from entering through the slide surface into the surroundings of the swing contact point 46, the electrode plate 41 and the like.

Particularly the contact point accommodating chamber S is formed as the space closed in the four-direction peripheries by overlapping the front upper accommodating wall 15*a* and lower accommodating wall 37*a*, the back upper accommodating wall 15*b* and lower accommodating wall 37*b*, and the side wall 12 and the side wall 32, which extend in the upper-lower direction from the upper case 10 and the lower case 30, respectively in a surface-surface contact state. Therefore the contact surfaces of the walls fixed with each other achieve a sealing effect against the entering of the foreign object.

The slider 60 has the recessed portion 73 formed by further providing the outer frame 71 outside of the opening end surface (inner frame 72) of the box portion 62. Therefore, just in case where foreign objects spill through the slide surface between the slider 60 and the lower surface of the ceiling wall 11 to the contact point accommodating chamber S from the box portion 62, since the foreign objects are trapped in the recessed portion 73, the foreign objects never adhere to the swing contact piece 46, the electrode plate 41 and the like. In addition, since the slider 60 has the pockets 78 adjacent to the engagement blocks 76 in the box portion 62, the movement of the foreign object having entered into the pockets 78 from the slit hole 24 to the slot 77 of the engagement blocks 76 is restricted to maintain a smooth connection state between the engagement portion 6 of the lever 5 and the engagement blocks 76.

Two sets of the electrode sets 40*a* and 40*b* are arranged in parallel in the contact point accommodating chamber S, the slider 60 is structured to press the swing contact piece 46 corresponding to each electrode set 40 with the ball 80 urged by the coil spring 69, and includes the horizontal plate portion 61 provided with two sets of the tubular portions 67 retaining the coil springs 69, both the ends of the horizontal plate portion 61 in the line direction of the tubular portions 67 are supported with the ceiling wall 11 (offset portion 11*a*) of the contact point accommodating chamber S, and the box portion 62 is opened between both the tubular portions 67 in the horizontal plate portion 61. Therefore since the slider 60 can be connected to the knob 2 by the single lever 5 in a state of being stably retained, the slit hole 24 for the passage of the lever 5 can be minimized in size and the entering of the foreign objects into the box portion 62 can be suppressed at a minimum.

It should be noted that in the present embodiment, for forming the contact point accommodating chamber S, the wall portions preventing the entering of foreign objects are formed by overlapping the upper accommodating walls 15*a* and 15*b* extending from the upper case 10 and the lower accommodating walls 37*a* and 37*b* extending from the lower case 30 in a surface-surface contact. However, in addition to it, a groove is provided in an end surface of one of the accommodating walls and an end edge of the other of the accommodating walls is fitted into the groove, thus defining a contact point accommodating chamber S, which thereby may be formed as wall portions for preventing the entering of foreign objects.

In addition, in regard to the assembling of the ball 80 and the coil spring 69 pressing the swing contact piece 46, as described above, the explanation is made of the example where the tubular portion 67 of the slider 60 is formed as the through hole, the long hole 65 of the side wall 64 is engaged to the click 56 of the outer guide wall 38 in a state where the lower end opening is in a line to the swing contact piece 46 supported by the each electrode plate 42, and in this state, the ball 80 and the coil spring 69 are inserted from the upper end opening of the tubular portion 67 and then the upper end of the tubular portion 60 is caulked. However, in addition to that, for example, after sequentially inserting a coil spring and a ball into a tubular portion with the upper end closed from the lower end opening, if the lower end opening of the tubular portion is caulked in a state where a part of the ball is exposed, the structure can be treated as an integral slider unit.

The present embodiment adopts the switch device of a type where the slider 60 makes the swing contact piece 46 swing to the fixed contact points 45 and 47. The present invention is not limited thereto, and can be applied to a switch device of the other type, such as a type where a slider supports a movable contact point to make the movable contact point slide to a fixed contact point.

The present invention can be applied to various types of switch devices where the installation space is narrow, and particularly is effective in use for a switch device for a powered window in an automobile.

While only the selected embodiment has been chosen to illustrate the present invention, it will be apparent to those skilled in the art from this disclosure that various changes and modifications can be made therein without departing from the scope of the invention as defined in the appended claims. Furthermore, the foregoing description of the embodiment according to the present invention is provided for illustration only, and not for the purpose of limiting the invention as defined by the appended claims and their equivalents.

DESCRIPTION OF THE CODES

1 Switch device
2 Knob
3 Shaft hole
4 Horn portion
5 Lever
6 Engagement portion
7 Spring retaining cylinder

7*a* Slit
8 Coil spring
9 Case
10 Upper case
11 Ceiling wall
11*a* Offset portion
12 Side wall
12*a* Stepped portion
13*a*, 13*b* Mount bracket portion
14 Engagement hole
15*a*, 15*b* Upper accommodating wall
16*a*, 16*b* Click
17 Hole
18 Knob support cylinder
18*a* Stopper
19*a*, 19*b*, 19*c* Side wall
20 Front longitudinal wall
21 Shaft boss
22 Partition wall
23 Groove
23*a* Bottom wall
24 Slit hole
25 Click wall
26 Click cam surface
27 Recessed portion
28 Ball
29 Tub
30 Lower case
31 Base
32 Side wall
33 Connector portion
34 Terminal
35 Engagement projection
35*a* Inclination surface
37*a*, 37*b* Lower accommodating wall
38 Outer guide wall
39 Inner guide wall
40, 40*a*, 40*b* Electrode set
41, 41*a*, 41*b* Electrode plate
42, 42*a*, 42*b* Electrode plate
43, 43*a*, 43*b* Electrode plate
45, 45*a*, 45*b* Contact point
46, 46*a*, 46*b* Swing contact piece
47, 47*a*, 47*b* Contact point
48 Trough
49, 50 Peak portion
53 Flange wall
54 Extension portion
55 Shoulder portion
56 Click
60 Slider
61 Horizontal plate portion
62 Box portion
63 Bottom wall
64 Side wall
65 Long hole
67 Tubular portion
68 Caulking portion
69 Coil spring
70 Frame portion
71 Outer frame
72 Inner frame
73 Recessed portion
75, 79 Projection
76 Engagement block
77 Slot
78 Pocket
80 Ball
F Front space
N Swing axis
R Back space
S Contact point accommodating chamber

What is claimed is:

1. A switch device comprising:

a knob;

an upper case for supporting the knob;

a lower case provided with a fixed contact point;

a movable contact piece connected to/disconnected from the fixed contact point; and a movable member linking to the movable contact piece, the knob being coupled to the movable member to switch connection/disconnection between the fixed contact point and the movable contact piece by an operation of the knob, wherein the upper case and the lower case form a contact point accommodating chamber for surrounding the fixed contact point and the movable contact piece, the movable member is arranged in the contact point accommodating chamber, the knob is provided with a lever for coupling the movable member to the knob, the contact point accommodating chamber has an upper wall provided with a slit hole for passage of the lever, the movable member is provided therein with a recessed portion having a connecting portion to the lever, and the movable member slides while an opening end surface of the recessed portion maintains surface contact with a lower surface of the upper wall surrounding the slit hole in such a manner that there are no gaps between the opening end surface of the recessed portion and the lower surface of the upper wall at least within a region on the lower surface of the upper wall that continuously surrounds the slit hole.

2. A switch device according to claim 1, wherein the contact point accommodating chamber is formed as a space closed in the four-direction peripheries by overlapping wall portions extending in the upper-lower direction from the upper case and the lower case, respectively in a surface-surface contact state.

3. A switch device according to claim 1, wherein the movable member further includes a first trapping recessed portion outside of the opening end surface of the recessed portion.

4. A switch device according to claim 1, wherein the movable member includes a second trapping recessed portion adjacent to the connection portion in the recessed portion.

5. A switch device according to claim 1, wherein the fixed contact point includes an electrode set comprising a first electrode, a second electrode, and a third electrode sequentially arranged, the movable contact piece includes a swing contact piece which is supported at an intermediate section by the second electrode and opposes the first electrode to the third electrode, and the movable member includes a pressing unit for pressing the swing contact piece, which presses the swing contact piece between a support position thereof by the first electrode and a support position thereof by the second electrode in a neutral position, wherein with the sliding of the movable member, when the pressing position by the pressing unit exceeds the support position and moves to the third electrode, a conducting state between the first electrode and the second electrode is switched to a conducting state between the third electrode and the second electrode.

6. A switch device according to claim 5, wherein two sets of the electrode sets are arranged in parallel in the contact point accommodating chamber, the pressing unit includes a ball urged by a spring and rolling on the swing contact piece, and the movable member includes a horizontal plate portion provided with two sets of tubular portions retaining the springs corresponding to the two sets of the electrode sets, wherein both ends of the horizontal plate portion in the line direction of the tubular portions are supported with an upper wall of the contact point accommodating chamber, and the recessed portion is opened between both the tubular portions.

7. A switch device comprising:

a knob;

an upper case that supports the knob;

a lower case provided with a fixed contact point;

a movable contact piece for selectively connecting to and disconnecting from the fixed contact point; and a movable member linking to the movable contact piece, the knob being coupled to the movable member to switch connection/disconnection between the fixed contact point and the movable contact piece by an operation of the knob, wherein the lower case and the upper case are connected to form a chamber in which the movable member is provided, the movable member has a recess provided therein, a first surface of the movable member forming a ledge that encompasses an opening of the recess;

the upper case has a slit hole provided therein, a second surface of the upper case forming a ledge that encompasses an opening of the slit hole, the knob is provided with a lever that extends through the slit hole into the recess and couples the movable member to the knob, while the movable member slides, the first and second surfaces maintain surface-to-surface contact with each other such that an interior volume is sealingly separated from an exterior volume by the contact, and the fixed contact point and the movable contact piece are provided in the interior volume, the interior volume being enclosed by the upper case, the lower case, and the movable member.

8. The switch device of claim 7, wherein, from a perspective facing the first surface, the entirety of the opening of the slit hole in the second surface is interior to the opening of the recess in the first surface.

9. A switch device comprising:

a knob;

an upper case that supports the knob;

a lower case provided with a fixed contact point;

a movable contact piece for selectively connecting to and disconnecting from the fixed contact point; and a movable member linking to the movable contact piece, the knob being coupled to the movable member to switch connection/disconnection between the fixed contact point and the movable contact piece by an operation of the knob, wherein the lower case and the upper case are connected to form a chamber in which the fixed contact point, the movable contact piece, and the movable member are provided, the movable member has a recess provided therein, a first surface of the movable member forming a ledge that encompasses an opening of the recess, the first surface being planar;

the upper case has a slit hole provided therein, a second surface of the upper case forming a ledge that encompasses an opening of the slit hole, the second surface being planar and parallel to the first surface;

the knob is provided with a lever that extends through the slit hole into the recess and couples the movable member to the knob, and while the movable member slides, the first and second surfaces maintain surface-to-surface contact with each other.

10. The switch device of claim 9, wherein, from a perspective facing the first surface, the entirety of the opening of the slit hole in the second surface is interior to the opening of the recess in the first surface.

11. A switch device comprising:

a knob;

an upper case that supports the knob;

a lower case provided with a fixed contact point;

a movable contact piece for selectively connecting to and disconnecting from the fixed contact point; and a movable member linking to the movable contact piece, the knob being coupled to the movable member to switch connection/disconnection between the fixed contact point and the movable contact piece by an operation of the knob, wherein the lower case and the upper case are connected to form a chamber in which the fixed contact point, the movable contact piece, and the movable member are provided, the movable member has a recess provided therein, an opening of the recess being provided in a first surface of the movable member;

the upper case has a slit hole provided therein, an opening of the slit hole being provided in a second surface of the upper case;

the knob is provided with a lever that extends through the slit hole into the recess and couples the movable member to the knob, and while the movable member slides, the first and second surfaces maintain surface-to-surface contact with each other such that an area of contact between the first and second surfaces completely encloses the opening of the recess from a perspective facing the first surface.

12. The switch device of claim 11, wherein, from a perspective facing the first surface, the entirety of the opening of the slit hole in the second surface is interior to the opening of the recess in the first surface.

13. A switch device comprising:

a knob;

an upper case for supporting the knob;

a lower case provided with a fixed contact point;

a movable contact piece connected to/disconnected from the fixed contact point; and a movable member linking to the movable contact piece, the knob being coupled to the movable member to switch connection/disconnection between the fixed contact point and the movable contact piece by an operation of the knob, wherein the upper case and the lower case form a contact point accommodating chamber for surrounding the fixed contact point and the movable contact piece, the movable member is arranged in the contact point accommodating chamber, the knob is provided with a lever for coupling the movable member to the knob, the contact point accommodating chamber has an upper wall provided with a slit hole for passage of the lever, the movable member is provided therein with a recessed portion having a connecting portion to the lever, and the movable member slides while an opening end surface of the recessed portion maintains surface contact with a lower surface of the upper wall surrounding the slit hole such that foreign objects are prevented from accumulating between the opening end surface of the recessed portion and the lower surface of the upper wall.

14. The switch device of claim 13, wherein, from a perspective facing the opening end surface of the recessed portion, the entirety of an opening of the slit hole in the lower surface of the upper wall is interior to an opening of a recess in the opening end surface of the recessed portion.

* * * * *